US005454713A

United States Patent [19]

Lee

[11] Patent Number: 5,454,713

[45] Date of Patent: Oct. 3, 1995

[54] DISPOSABLE 2-STEP SAFETY LIGHTER

[75] Inventor: Pao-Chen Lee, Taichung, Taiwan

[73] Assignee: One More Ent., Ltd., Taichung, Taiwan

[21] Appl. No.: 248,090

[22] Filed: May 24, 1994

[51] Int. Cl.[6] ..... F23D 11/36

[52] U.S. Cl. ..... 431/153; 431/277

[58] Field of Search ..... 431/153, 276, 431/277

[56] References Cited

U.S. PATENT DOCUMENTS

| | | | |
|---|---|---|---|
| 3,205,685 | 9/1965 | Heling | 431/277 |
| 4,786,248 | 11/1988 | Nitta . | |
| 4,919,610 | 4/1990 | Nitta | 431/277 |
| 5,197,870 | 3/1993 | Yang | 431/153 |

FOREIGN PATENT DOCUMENTS

| | | | |
|---|---|---|---|
| 55-92822 | 7/1980 | Japan | 431/277 |
| 9000704 | 1/1990 | WIPO | 431/277 |

*Primary Examiner*—Carroll Dority
*Attorney, Agent, or Firm*—Bacon & Thomas

[57] ABSTRACT

A disposable 2-step safety lighter includes a fuel lever and spark wheel installed in different positions and completely separate. The working direction of both devices are different, with the fuel lever being pivotally mounted about a horizontal axis and the spark wheel being rotatably mounted about a vertical axis. Therefore, the lighter must be operated in two steps precisely or it can not be lit up, thereby increasing the difficulty of operation so as to prevent children from playing with the lighter ignorantly.

4 Claims, 3 Drawing Sheets

DISPOSABLE 2-STEP SAFETY LIGHTER

BACKGROUND OF THE INVENTION

The present invention relates to a disposable lighter, and more particularly to a disposable 2-step safety lighter.

The prior art disposable lighter, illustrated in FIG. 1, has the valve 11 for controlling gas leakage and spark wheel 12 installed in the same position. The user turns said spark wheel 12 downward and presses said valve 12 for controlling the leakage of gas. It seems like a very practical lighter, however, if we take a look at it more closely, we would find out that the prior art disposable lighter lacks safety protection. Said valve 11 and said spark wheel 12 are located in the same position and operated in the same direction, in other words, the lighter could be operated easily even by a little kid. Although it would be convenient to the adult for lighting, it could be played by the children to burn down houses and lives ignorantly. Therefore, in view of the above-mentioned serious drawback, the inventor of the present invention had been endeavoring for many years to discover a new type of lighter which would eliminate the aforesaid disadvantage. And he has finally invented a disposable 2-step safety lighter.

SUMMARY OF THE INVENTION

It is therefore the main object of the present invention to provide a disposable 2-step safety lighter whose gas controlling button and spark wheel are separate from each other completely and installed in different positions. Therefore, the lighting process would be changed to two separate steps. If the user wants to light a fire, said steps must be done exactly. It is still convenient to the adult but would be difficult for the children to light. Such modification becomes a fuse for preventing children from playing lighter ignorantly.

The disposable 2-way safety lighter of the present invention comprising:

- a tank body for containing fuel;
- a frame fixing in the top open of said tank body;
- a nozzle and fiber fuel pipe mounting vertically in said frame wherein said fiber fuel pipe extends to the interior of said tank body;
- a flint set inside said frame;
- a screw cap mounted on said nozzle and screwed on said frame;
- a adjust ring cogged on said screw cap which can be turned within a limited angle;
- a fuel button which installed pivotally in said frame and has one side fastened on said nozzle for controlling the leakage of fuel;
- a spark wheel installed pivotally on said frame corresponding with said flint set, which can be turned to frictionize said flint for the spark;
- a metal cap installed in said frame wherein several opens are installed for mounting said adjust ring, said fuel button and said spark wheel;

Said fuel button and said spark wheel are separate from each other completely and installed pivotally in different positions on said frame, said fuel button is installed horizontally and said said spark wheel is mounted pivotally vertically. In addition, the shape of the disposable 2-way safety lighter is designed in the shape of parallelepiped for the convenience of holding by human palm. Such structure would effectively prevent children from burning themselves or jeopardizing lives and poverties.

DETAILED DESCRIPTION OF THE PREFERRED EMBODIMENTS

Figure 4:
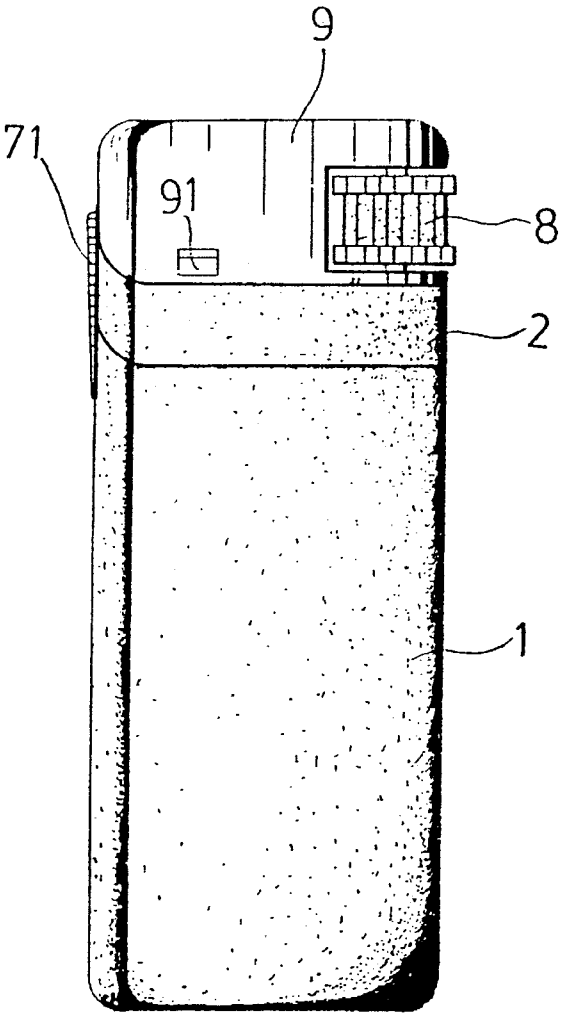
FIG. 4 is a plain view of the present invention.
Figure 1:
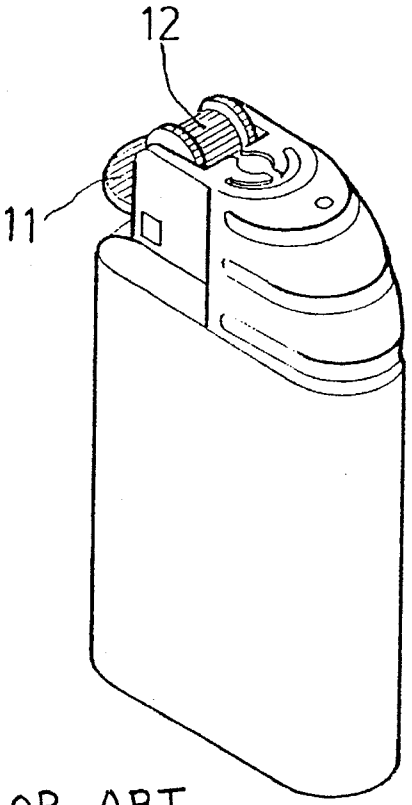
PRIOR ART FIG.1
FIG. 1 is an external drawing of the prior art disposable lighter.
Figure 2:
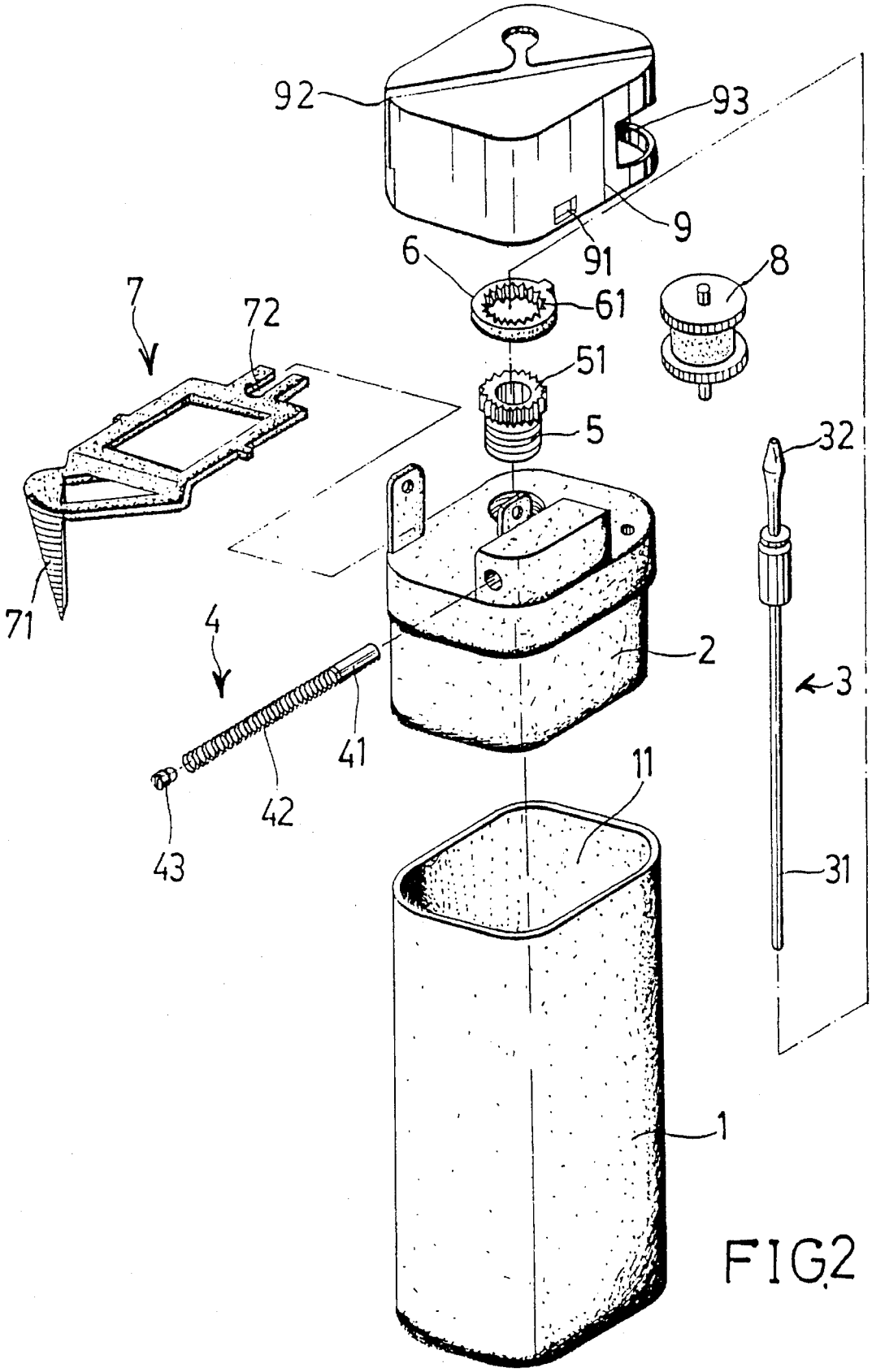
FIG. 2 is an exploded view of the present invention.
Figure 3:
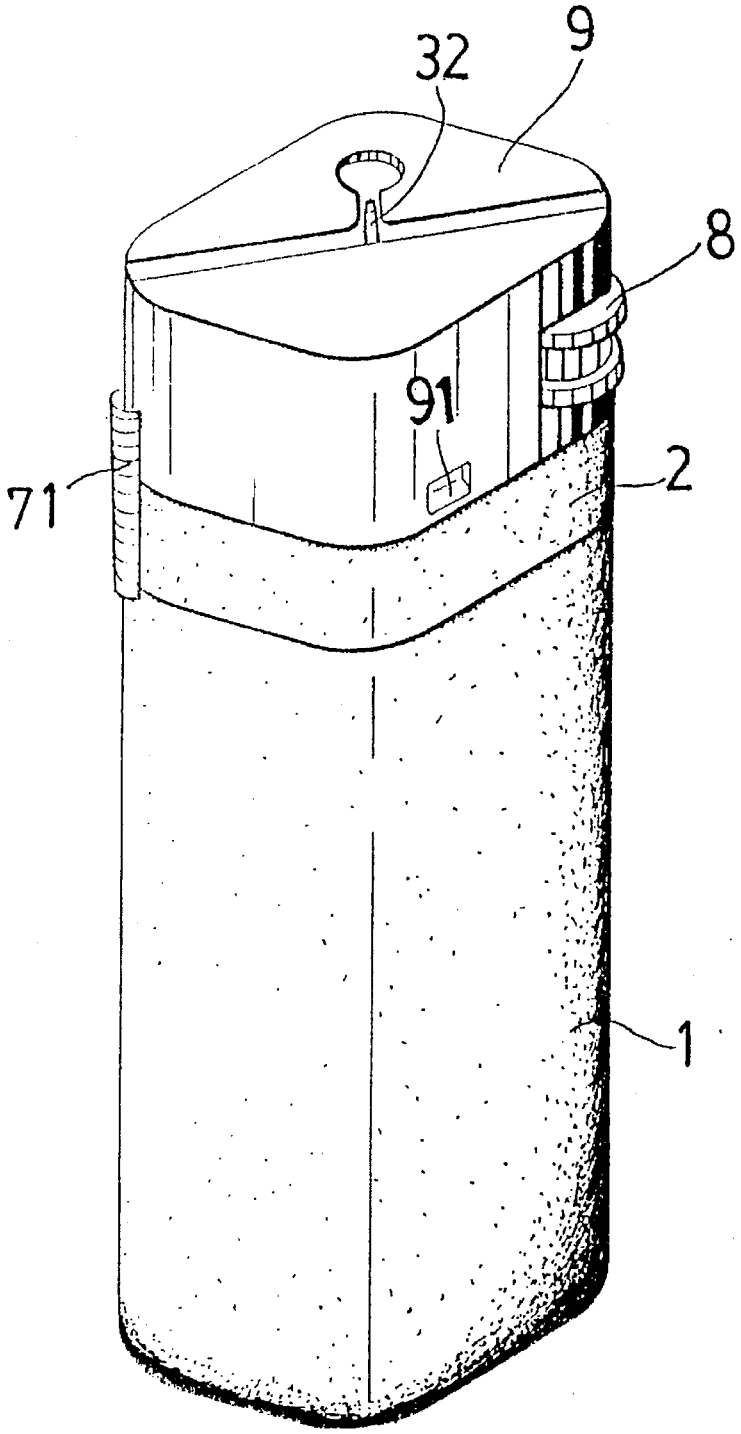
FIG. 3 is a assembly view of the present invention.

Referring to attached figures, the disposable 2-way safety lighter of the present invention is mainly consisted of a tank body 1, a frame 2, a fuel fiber pipe and nozzle 3, a flint set 4, a screw cap 5, a adjust ring 6, a fuel button 7, a spark wheel 8 and a metal cap;

- said tank body 1 is used to contain gas and in the shape of parallelogram;
- said frame 2 is also in the shape of parallelogram and fixed in the top open 11 of said tank body 1;
- said fuel fiber pipe and nozzle 3 is installed vertically in said frame 2 and has the fuel fiber pipe 31 extended to the inside of said tank body 1;
- said flint set 4 is installed horizontally inside said frame 2 and mainly consisted of a flint 41, spring 42 and tap 43. One side of said flint 41 would be the only part of said flint set 4 exposed outside;
- said screw cap 5 is connected to said nozzle 32 and screwed on said frame 2;
- said adjust ring 6 has inner teeth 61 cogged with teeth 51 of said screw cap 5 and can be turned within a certain limited angle to control the leakage amount of gas;
- said fuel button 7 is horizontally installed in said frame 2 and has an extended part 71 connected with said tank body 71 and the other end 72 fastened on said nozzle 32, said extended part 71 can be used to control the leakage of gas;
- said spark wheel 8 is installed vertically and pivotally in said frame 2 (opposite to said fuel button 7), and corresponds with the exposed end of flint 41 of said flint set 4, when spark wheel 8 is turned, it would frictionize said flint 41 and make the spark;
- said metal cap 9 is also in the shape of parallelogram and cup jointed to said frame 2, wherein several openings are installed for mounting said adjust ring 6, fuel button 7 and spark wheel 8.

To use the present invention, the user should turn said fuel button 7 and said spark wheel 8 vertically and horizontally in 2 steps. Although said fuel button 7 and said spark wheel 8 are opposite to each other, the adult's palm can still hold and operate said lighter easily and conveniently. The design of parallelepiped enables the user to hold said lighter stably. On contrary, a little child would never have a chance to light up because of the specially designed structure and installation.

According to the above description, the fuel button and spark wheel are separate completely and mounted in different positions so that the light up would not be done in one time but has to be operated with two separate procedures exactly. The adult still can operate said lighter easily and conveniently, but the children, who lack recognition of structure, would feel difficult to operate said lighter. Therefore, the special design of said structure becomes a fuse to prevent the children from jeopardizing lives and properties ignorantly.

While only few embodiments of the present invention has been shown and described, it will be understood that various modifications and changes could be made without departing from the spirit and scope of the invention.

What is claimed is:

1. A disposable safety lighter comprising:

a tank body for containing fuel, said tank body having a top section;

a frame member fixedly secured to the top section of said tank body;

a fuel pipe having a first end portion formed with a nozzle and a second end portion, the second end portion of said fuel pipe being located within said tank body and the first end portion extending through said frame member;

a flint set mounted to said frame member;

a screw cap extending about said nozzle and being threadably secure to said frame member;

an adjustment ring cogged on said screw cap for rotating said screw cap relative to said frame member through a predetermined angle range;

a fuel lever having first and second terminal end portions and an intermediate portion, said intermediate portion being pivotally attached on said frame member to permit pivotal movement of said fuel lever about a horizontal axis, said first terminal end portion being connected to said nozzle and said second terminal end portion extending along an outer surface portion of said frame member such that pivoting of said fuel lever about said horizontal axis through manual engagement of said second terminal end portion controls the leakage of fuel through said nozzle;

a spark wheel attached to said frame member for rotation about a vertical axis, said spark wheel being engaged with said flint set such that rotation of said spark wheel against said flint set creates a spark; and a cap installed on said frame member, said cap being formed with several openings through which said adjustment ring, said fuel lever and said spark wheel respectively project.

2. A disposable lighter according to claim 1, wherein said spark wheel is rotatably supported by both said frame member and said cap.

3. A disposable lighter according to claim 1, wherein said frame member includes a pair of spaced, upstanding support members which pivotally support the intermediate portion of said fuel lever.

4. A disposable lighter according to claim 1, wherein said safety lighter is parallelepiped shape so as to define four elongated corner portions, said fuel lever and said spark wheel extending through said openings in said cap at opposing corner portions of said safety lighter.

* * * * *